US011411295B2

(12) United States Patent
Micovic

(10) Patent No.: US 11,411,295 B2
(45) Date of Patent: Aug. 9, 2022

(54) ANTENNA SUB-ARRAY BLOCKS HAVING HEAT DISSIPATION

(71) Applicant: Raytheon Company, Waltham, MA (US)

(72) Inventor: Miroslav Micovic, Marana, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/025,333

(22) Filed: Sep. 18, 2020

(65) Prior Publication Data

US 2022/0094031 A1 Mar. 24, 2022

(51) Int. Cl.

| | |
|---|---|
| ***H01Q 21/00*** | (2006.01) |
| ***H01Q 1/02*** | (2006.01) |
| ***H01Q 3/26*** | (2006.01) |
| ***H01Q 21/06*** | (2006.01) |

(52) U.S. Cl.

CPC ..... *H01Q 1/02* (2013.01); *H01Q 3/2617* (2013.01); *H01Q 21/0031* (2013.01); *H01Q 21/065* (2013.01)

(58) Field of Classification Search

CPC ..... H01Q 1/02; H01Q 3/26; H01Q 3/2617; H01Q 21/00; H01Q 21/0031; H01Q 21/06; H01Q 21/065; H01Q 1/22; H01Q 1/2283; H01Q 21/061

See application file for complete search history.

(56) References Cited

U.S. PATENT DOCUMENTS

| | | | | |
|---|---|---|---|---|
| 6,005,531 | A * | 12/1999 | Cassen | H01Q 21/0025 343/853 |
| 6,952,345 | B2 * | 10/2005 | Weber | F28D 15/0266 165/80.4 |
| 7,187,342 | B2 * | 3/2007 | Heisen | H01Q 13/02 343/700 MS |
| 7,443,354 | B2 | 10/2008 | Navarro et al. | |
| 7,889,147 | B2 * | 2/2011 | Tam | H01Q 21/0025 343/777 |

(Continued)

FOREIGN PATENT DOCUMENTS

| | | | |
|---|---|---|---|
| EP | 1381083 | A2 | 1/2004 |
| WO | WO-2015/037007 | A1 | 3/2015 |

OTHER PUBLICATIONS

PCT International Search Report and Written Opinion dated Jun. 7, 2021 for International Application No. PCT/2021/019153; 17 Pages.

(Continued)

*Primary Examiner* — Tho G Phan

(74) *Attorney, Agent, or Firm* — Daly, Crowley Mofford & Durkee, LLP

(57) ABSTRACT

Methods and apparatus to provide a rectangular N×M antenna element subarray block having opposed first and second major surfaces and first and second ends at opposite ends of the block, wherein the antenna elements are located at the first end of the block. A coldplate between the first inlet connector and the first outlet connector enables flow of the liquid coolant from the first inlet connector to the first outlet connector. The first inlet connector is configured to enable flow of the liquid coolant into the system in a direction that is normal to the first major surface of the block.

11 Claims, 10 Drawing Sheets

(56) References Cited

U.S. PATENT DOCUMENTS

| | | | | |
|---|---|---|---|---|
| 7,940,524 | B2 * | 5/2011 | Rummel | H01Q 3/26 361/689 |
| 8,107,894 | B2 | 1/2012 | Lowell et al. | |
| 8,654,017 | B1 * | 2/2014 | Voss | H01Q 1/02 343/705 |
| 8,837,148 | B2 * | 9/2014 | Giovannelli | H01Q 21/0025 361/702 |
| 9,362,609 | B2 | 6/2016 | Brown et al. | |
| 9,485,869 | B2 | 11/2016 | Schuster | |
| 2012/0105290 | A1 | 5/2012 | Brown et al. | |
| 2020/0028278 | A1 | 1/2020 | Tomasic et al. | |

OTHER PUBLICATIONS

Brown et al., "7Kw W-Band Transmitter;" 2016 IEEE MTT-S International Microwave Symposium (IMS); May 22, 2016; 3 Pages.

Golcuk et al., "A 90-100 GHz 44 SiGe BiCMOS Polarimetric Transmit-Receive Phased Array With Simultaneous Receive-Beams Capabilities;" IEEE Transactions on Microwave Theory and Techniques, vol. 61, Issue 8; Aug. 2013; 4 Pages.

Valdes-Garcia et al., "A Fully-Integrated Dual-Polarization 16-Element W-Band Phased-Array Transceiver in SiGe BiCMOS;" Conference Paper from IEEE Radio Frequency Integrated Circuits Symposium; Jun. 2013; 4 Pages.

* cited by examiner

ANTENNA SUB-ARRAY BLOCKS HAVING HEAT DISSIPATION

BACKGROUND

As is known in the art, systems that include electronics may generate significant amounts of heat that must be dissipated. For example, phased array radar systems have antenna arrays for transmitting and/or receiving signals. An Active Electronically Steerable Array (AESA), for example, may require half-wavelength spacing between antenna elements to achieve grating lobe free beam steering for scan angles exceeding 60 degrees. At high frequencies (e.g., greater than 50 GHz) it becomes challenging to integrate electronic components required for high power AESAs into a two-dimensional half wavelength lattice while simultaneously dissipating heat generated by high power GaN MMIC power amplifiers, for example.

SUMMARY

Embodiments of the disclosure provide methods and apparatus for an antenna element subarray block having liquid coolant flow into and out of the block so as to increase heat dissipation as compared with conventional configurations. In embodiments, subarray blocks can be stacked so that adjacent blocks have coolant inlet and outlet connections to each other. The inlet and outlet connections may establish coolant flow into and out of the blocks in a direction normal to a major surface of the block.

In embodiments, the subarray block has N×M antenna elements, wherein M may equal 1. A compact cold plate may have micro-channels for forced liquid cooling for effective heat removal from the subarrays. Example subarray blocks have 8×1 elements. The subarray blocks may have a connector configured to provide power, RF and control signals between subarray blocks. In some embodiments, a beamformer subarray circuit can be provided on subarray blocks. In embodiments, an antenna array can include utility blocks that may enable an increase the overall size of an array.

In embodiments, the subarray blocks can be stacked to provide an antenna array for an AESA system that is compatible with a half-wavelength element spacing at a frequency as high as 100 GHz and even higher, and is also effective in dissipating heat generated on each element. For example, the cooling can be achieved for GaN MMIC amplifiers producing 1 W of RF power in CW mode at a frequency of 100 GHz. No known subarray element can provide adequate cooling for a system with this level of power at half-wavelength element spacing at 100 GHz.

In one aspect, an apparatus comprises: a rectangular N×M antenna element subarray block having opposed first and second major surfaces and first and second ends at opposite ends of the block, wherein the antenna elements are located at the first end of the block; a first inlet connector in the first major surface for flow of a liquid coolant; a first outlet connector in the first major surface for flow of the liquid coolant; and a coldplate between the first inlet connector and the first outlet connector to enable flow of the liquid coolant from the first inlet connector to the first outlet connector, wherein the first inlet connector is configured to enable flow of the liquid coolant into the block in a direction that is normal to the first major surface.

In another aspect, an array comprises: a number of stacks of N×M element subarray blocks each having opposed first and second major surfaces, first and second ends at opposite ends of block, wherein the antenna elements are located at the first end of the blocks, inlet and outlet connectors in the first major surface for flow of a liquid coolant, inlet and outlet connectors in the second major surface for flow of the liquid coolant, wherein the inlet and outlet connectors are configured to provide flow of the liquid coolant from block-to-block, a coldplate between the inlet connector and the outlet connectors to enable flow of the liquid coolant through the coldplate, wherein the inlet connector on the first major surface is configured to enable flow of the liquid coolant into the system in a direction that is normal to the first major surface.

BRIEF DESCRIPTION OF THE DRAWINGS

The foregoing features of this disclosure, as well as the disclosure itself, may be more fully understood from the following description of the drawings in which.

DETAILED DESCRIPTION

Figure 1:
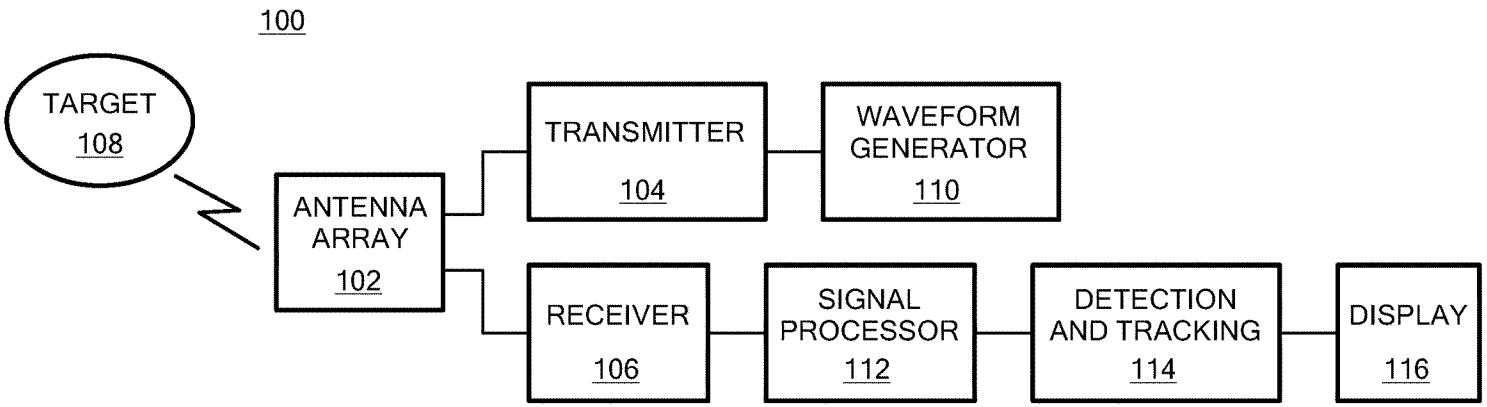
FIG. 1 is a block diagram of an example system having subarray blocks in accordance with illustrative embodiments of the disclosure.

FIG. 1 shows an example radar system 100, such as an active electronically steerable array (AESA) system, including an antenna array 102 having subarrays formed from stacked subarray blocks in accordance with example embodiments of the disclosure. An antenna array 102 is coupled to a transmitter system 104 and a receiver system 106. The radar system 100 can transmit signals that can be reflected by a target 108 and received by the antenna array 102. In some embodiments, the transmitter and receiver systems are physically separate from each other. In some embodiments, the system is passive so that signals are not transmitted.

A waveform generator 110 can generate signals for the transmitter system 104. Signal return can be received by the receiver system 106 and processed by a signal processor 112. A detection and tracking module 114 is configured to detect and track targets, such as target 108, from the processed signal return. Radar information, which can include target tracking, can be shown on a display 116.

Figure 2:
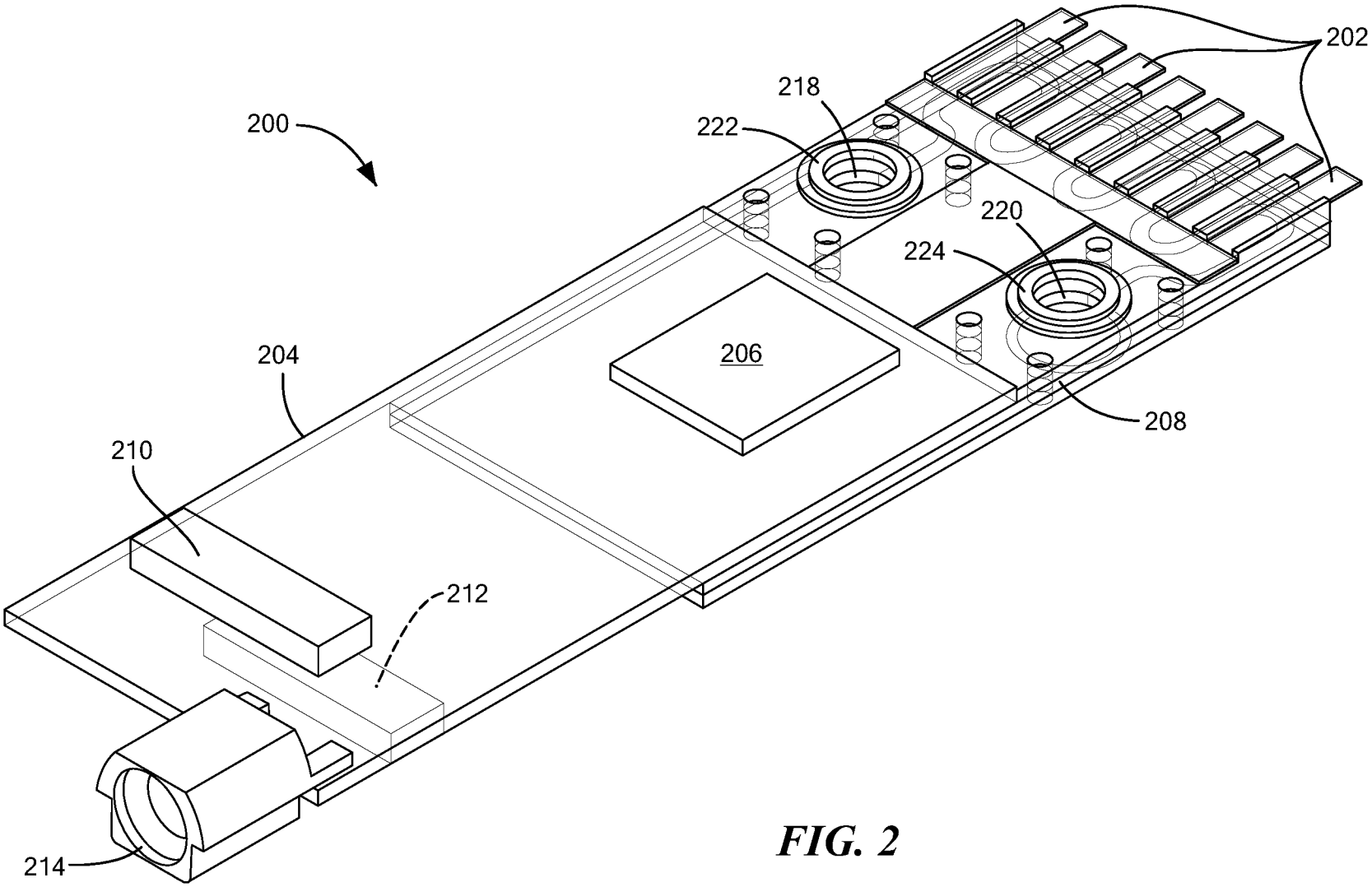
FIG. 2 is a partially transparent perspective view of an example N×M element subarray block in accordance with illustrative embodiments of the disclosure.

FIG. 2 shows an example N×M element subarray block 200 that can also be referred to as a 'brick.' In embodiments, M=1 so that an antenna subarray block includes N×1 elements 202. In embodiments, the elements 202 of the subarray block 200 include integrated circuits configured for high radiation efficiency. In one embodiment, the integrated circuits comprise W-band GaN MMICs having on-chip antennas with an element spacing of λ/2, e.g. 1.5 mm with a MMIC width of 1 mm.

A PCB 204, such as a multilayer PCB, is connected to the subarray elements 202. An integrated circuit 206, such as a beamformer circuit, can be attached to a cold plate 208. The beamformer circuit 206 can generate beams from up-converted LO and IF signals in a manner well-known in the art. A first connector 210 can provide power, IF, inter-board communications, and/or clock signals for an adjacent subarray block in a stack. A second connector 212 can provide similar signals for an adjacent block on the other side of the subarray. A third connector 214, which can be located on an end of the block 200, can provide local oscillator (LO) signals, for example.

The cold plate 208 can include microchannels for fluid flow. An input flow connection 218 can be located on one side of the cold plate 208 and an output flow connection 220 can be located on the other side of the cold plate. In embodiments, a liquid, such as water, at a relatively cool temperature, flows into the input flow connection 218, travels through the microchannels, and exits the output flow connection 220 after absorbing heat, which will raise the temperature of the liquid. Respective seals 222, 224 on the input and output flow connections 218, 220 provide a closed connector in the absence of an adjacent block. When there is an adjacent, connected block, the seals 222, 224 provide a fluid path between the adjacent blocks. The input and output flow connections 218, 220 are configured to have a liquid flow into the block and out of the block in a direction normal to a major surface of the block.

In embodiments, the subarray elements or block generally have a rectangular shape in the form of a printed circuit board configured for insertion into a slot in an enclosure. As used herein, a "major surface" of the subarray element refers to a surface having a greatest surface area. For example, a typical PCB has top and bottom major surfaces and four sides or edges. A rectangular PCB has first and second ends. Dimensions for an example block are W=12 mm, H=1.5 mm, and L=45 mm.

There is a relatively large aspect ratio between cold plate 208 surface area and RF radiating surface area of the elements 202 that promotes heat management. Forced micro-channel liquid cooling in the cold plate 208 provides efficient heat removal for enabling effective heat management of high power GaN MMICs and heat generating DSP components, for example, in addition to supporting heat fluxes generated by digital beamformers, for example.

In embodiments, the seals 222, 224 for the coolant connections 218, 220 can be provided as O-rings that provide brick-to-brick seals and flex during assembly. It is understood that the seals 222, 224 can comprise any practical size, geometry and material to meet the needs of a particular application. In embodiments, the brick to brick seals are closed by compressing stacked bricks together using frame plates that provide mechanical support to the bricks and fasteners that run through fastener openings in the brick and in the frame plates. The compression force squeezes O-ring into shallow recess openings that are machined into the cold plate to facilitate O-ring placement. The portion of the cold plate surrounding the O-ring protrudes slightly above the surface of the cold plate to act as a stopper as bricks are compressed together by fasteners. To enhance rigidity of the assembled array, small guide pins and corresponding mating guide holes are machined into the cold plate. These pins and holes mate as bricks are compressed and lock bricks together against lateral movements. The seals can be opened by removing fasteners and compressive force between bricks.

Figure 2A:
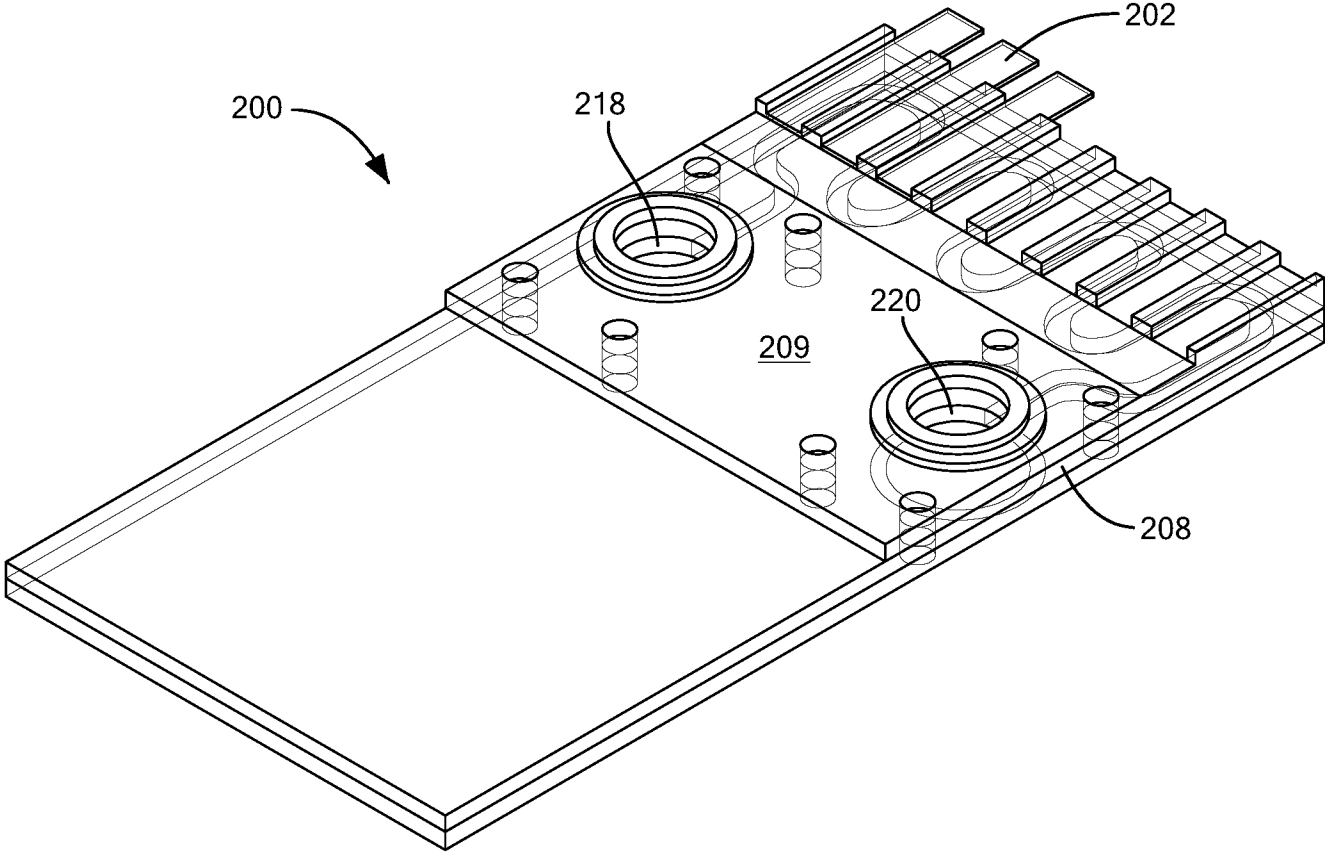
FIG. 2A shows a coldplate that can form a portion of the subarray block of FIG. 2 in accordance with illustrative embodiments of the disclosure.

FIG. 2A shows a portion of the subarray block 200 of FIG. 2 including a diffusion bonded coldplate 208 having microchannels 209 to provide a path between the input and output flow connections 218, 220. Microchannel coldplates refer to multi-pass parallel flow heat exchangers having inlet and outlet manifolds, multi-port tubes with hydraulic diameters smaller than 1 mm, for example, and fins. The microchannels may provide high heat transfer ratio, low refrigerant charges, compact size, and lower airside pressure drops compared to finned tube heat exchangers. One example coldplate having microchannels is shown and described in U.S. Pat. No. 7,443,354, which is incorporated herein by reference.

Figure 3:
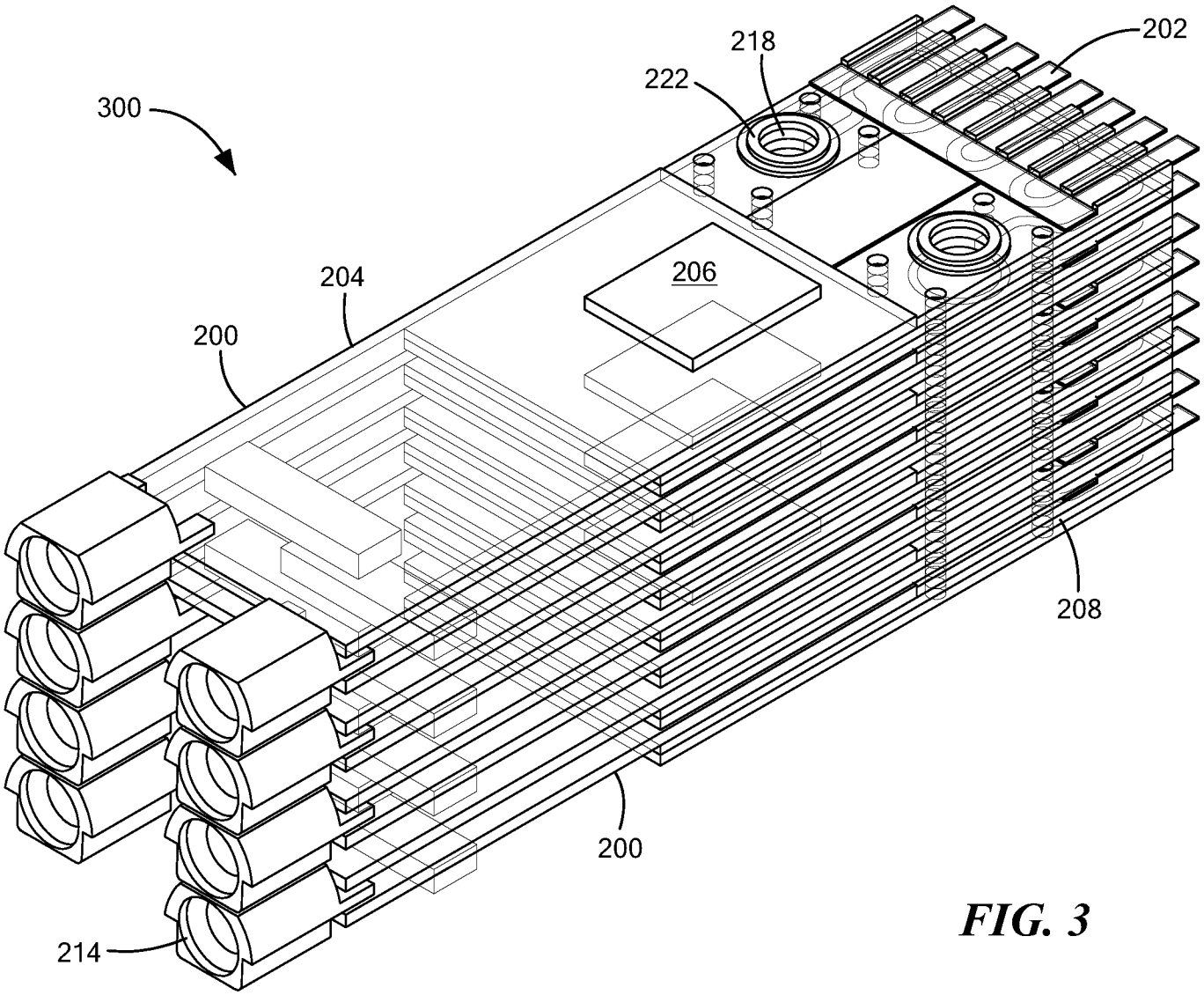
FIG. 3 is a partially transparent perspective view of an example stack of N×M element subarray blocks in accordance with illustrative embodiments of the disclosure.

FIG. 3 shows a stack 300 of eight connected 8×1 subarray blocks, which may comprise the subarray blocks 200 of FIG. 2. The illustrated stack 300 provides an 8×8 subarray. In one embodiment, cooled liquid flows into inlet 218 in a direction normal to the major top surface of the uppermost subarray element and heated liquid flows out of outlet 220. The seals (not clearly shown) on the bottom major surface of the lowermost block 200 in the stack 300 are closed. As described above, cooled liquid flows into each block in the stack at the inlet connector 218, passes through microchannels of the cold plate 208, and heated liquid exits each block at the outlet connector 220.

In embodiments, the block cooling liquid supply openings 218, 220 are normal to the major surface of the cold plate 208 to enable larger channel diameters for higher flow rates and to provide optimal geometry for element stacking. Board-to-board connectors 210, 212 provide high density interconnects for distribution of power, clock, control signals and data between subarrays. Push on SMPM connectors, for example, can provide a suitable interface for LO distribution.

Figure 4A:
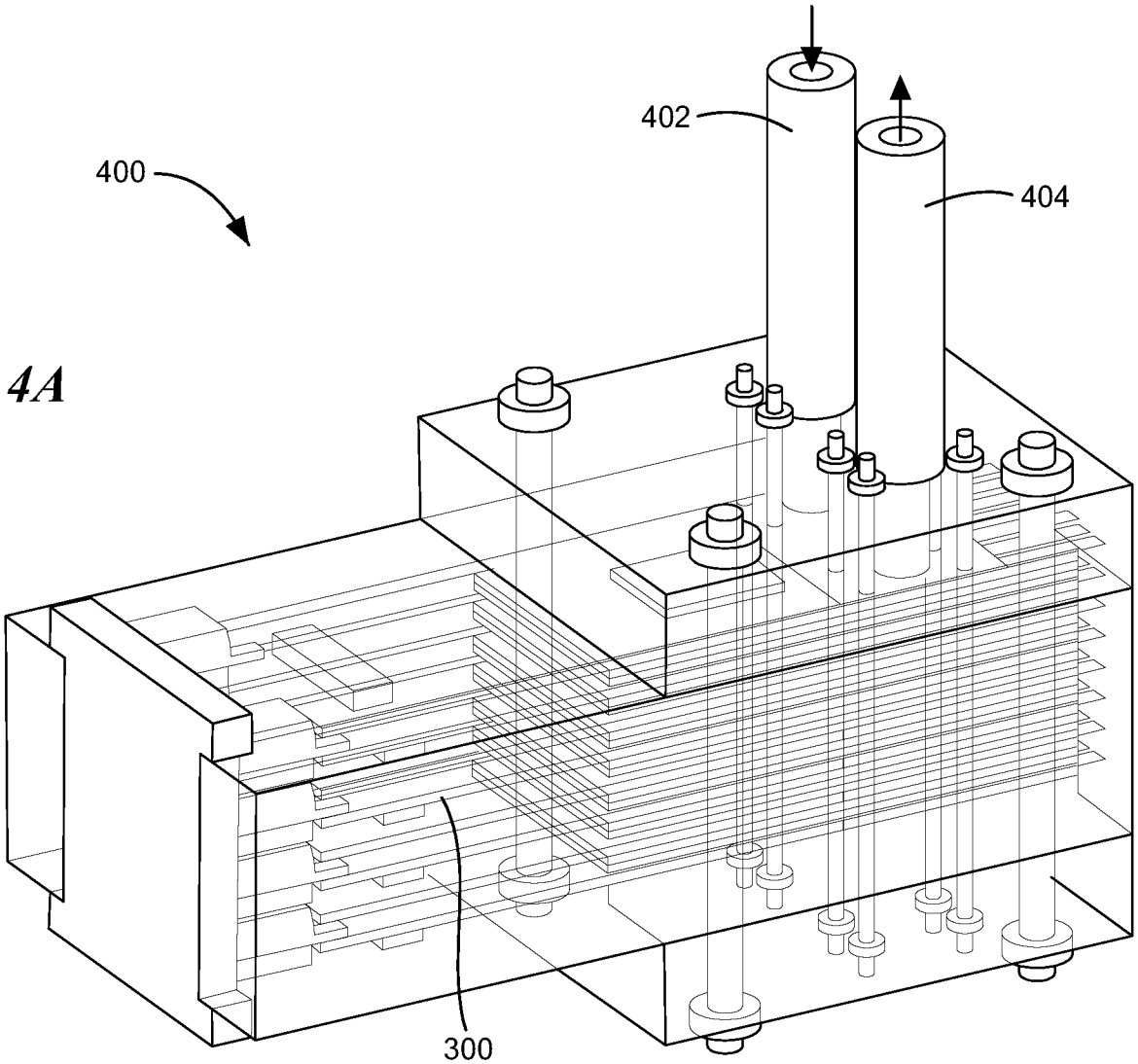
FIGS. 4A and 4B are partially transparent perspective view of an example stack of N×M element subarray blocks in an enclosure in accordance with illustrative embodiments of the disclosure.
Figure 4B:
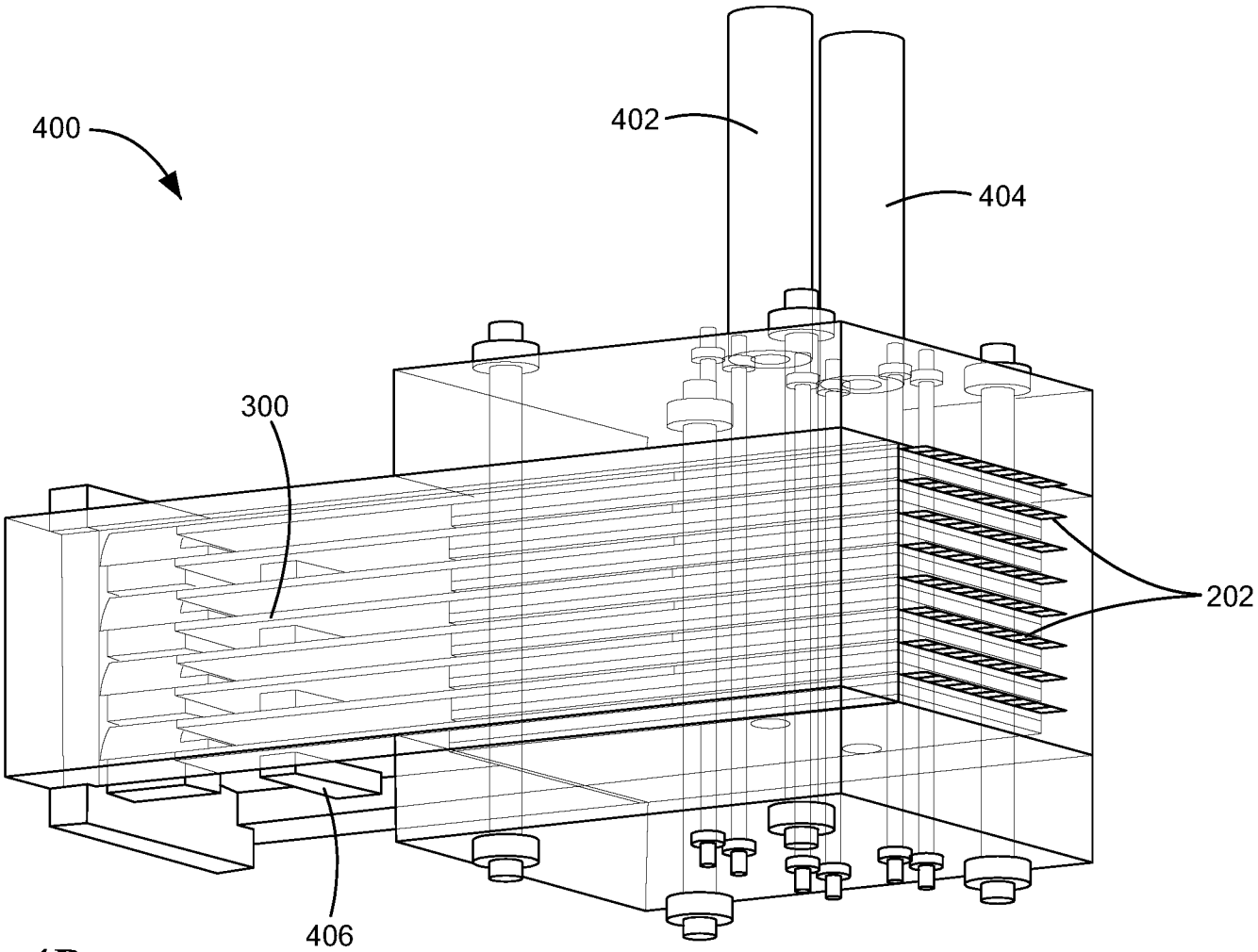

FIGS. 4A and 4B show partially transparent perspective views of an example enclosure 400 having a stack 400, which may comprise the subarray stack 300 of FIG. 3, with a coolant inlet 402 for the enclosure and a coolant outlet 404 for the enclosure. Antenna elements 202 can have wavelength λ/2 spacing in y and z axes. A connection 406 at the bottom of the enclosure can provide power, IF, communications, and the like.

In example embodiments, stacked subarray blocks in the enclosure 400 are tightly pulled together into a physical contact using small diameter screws or tension wires that run through openings normal to the subarray plane. Guide groves and alignment pins can be used for additional rigidity. It is understood that a wide variety of mechanical devices and structures can be used to secure the stacked subarrays in the enclosure.

Figure 5:
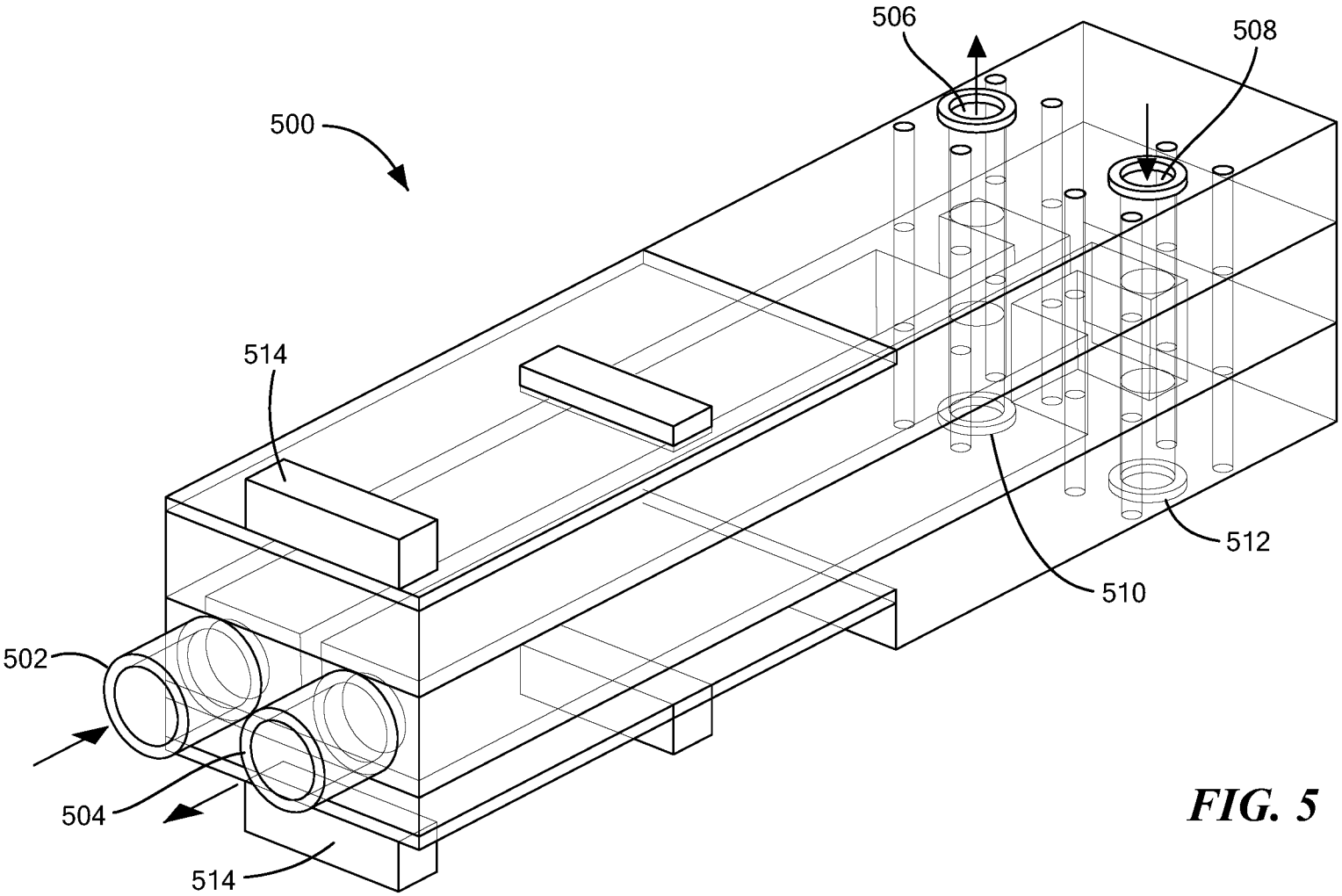
FIG. 5 is a partially transparent perspective view of an example utility block that can form part of an array in accordance with illustrative embodiments of the disclosure.
Figure 5A:
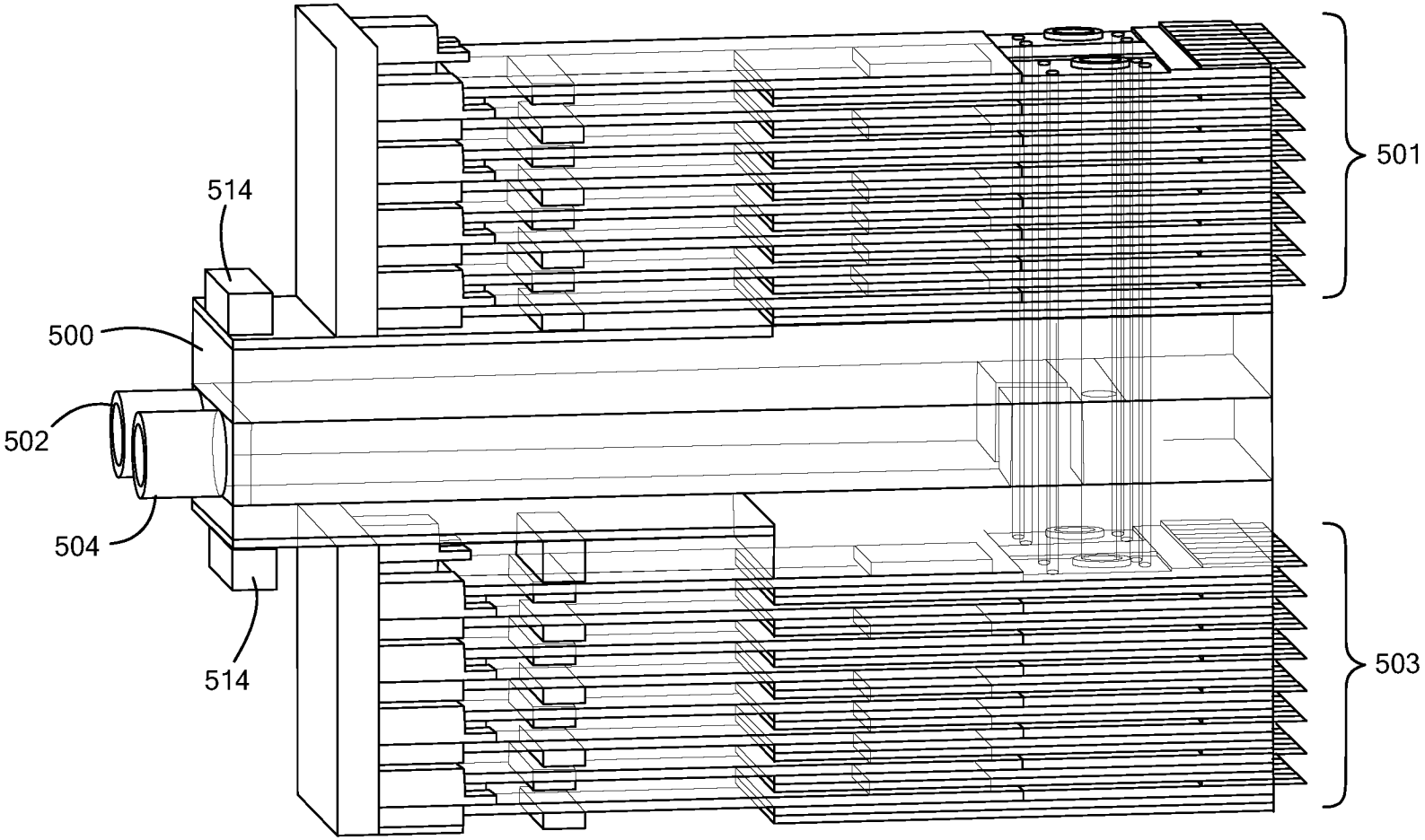
FIG. 5A is a partially transparent perspective view of an example utility block connected to stacks of N×M element subarray blocks in accordance with illustrative embodiments of the disclosure.

FIG. 5 shows an example utility block 500 that may enable an increase in the size of an array. For example, for stacks larger than 32×32 elements, the use of utility blocks 500 may enable an array size of greater than 10,000 elements. While there may be some tradeoffs between array size and beam spoiling from the utility blocks, the benefits of a larger array size will be readily apparent to one of ordinary skill in the art. FIG. 5A shows a utility block 500 connected to a stack 501 of subarray elements above the utility block and a stack 503 of subarray elements below the block.

The utility block 500 can include a main coolant inlet 502 and a main coolant outlet 504. The main coolant inlet 502 can receive chilled coolant that exits the utility block via a first stack coolant connector 506 for enabling coolant to flow into a stack of subarray elements, as described above. The main coolant outlet 504 can allow heated coolant to flow out of the utility block 500. A second coolant connector 508 can receive heated coolant from a stack of subarray elements, as described above. The utility block 500 can further include third and fourth coolant connectors 510, 512 at the bottom of the block for connection to stack located underneath the utility block. A main connector 514 can provide connections to a main system for the utility block 500 for power, IF, communications, and the like.

Figure 6:
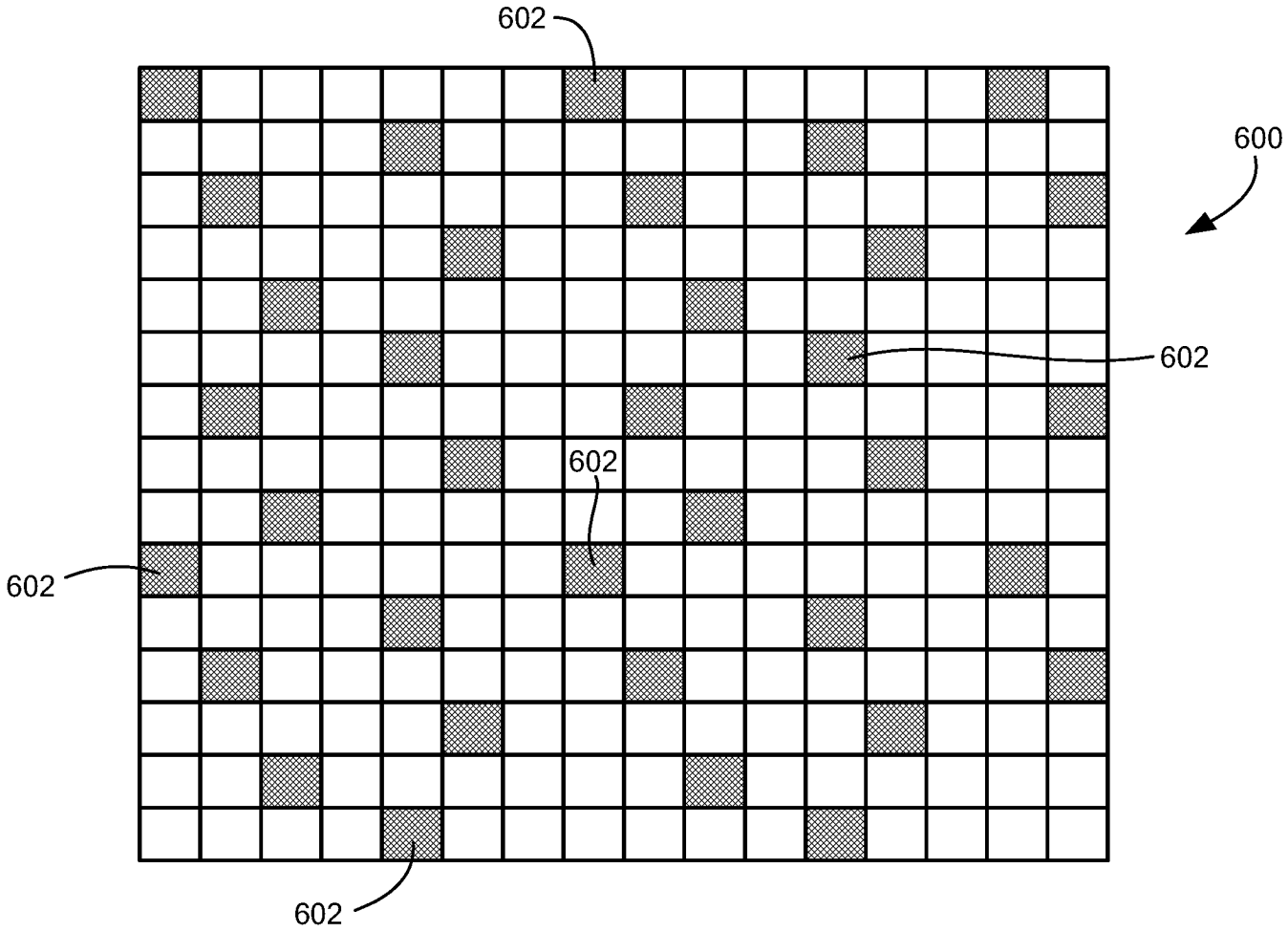
FIG. 6 is a schematic representation of an array having example utility blocks that can form part of the array in accordance with illustrative embodiments of the disclosure.

FIG. 6 shows an example array 600 having utility blocks 602, which are shown as darkened, at various locations in the array. The illustrated array 600 is 128×128 elements and 86 percent of the array is populated with active antenna elements. In embodiments, the utility blocks 602 do not transmit or receive signals. The utility blocks 602 increase the cooling capability by increasing coolant flow into and out of the array. The increased cooling capability enables the use of a larger array.

Figure 7:
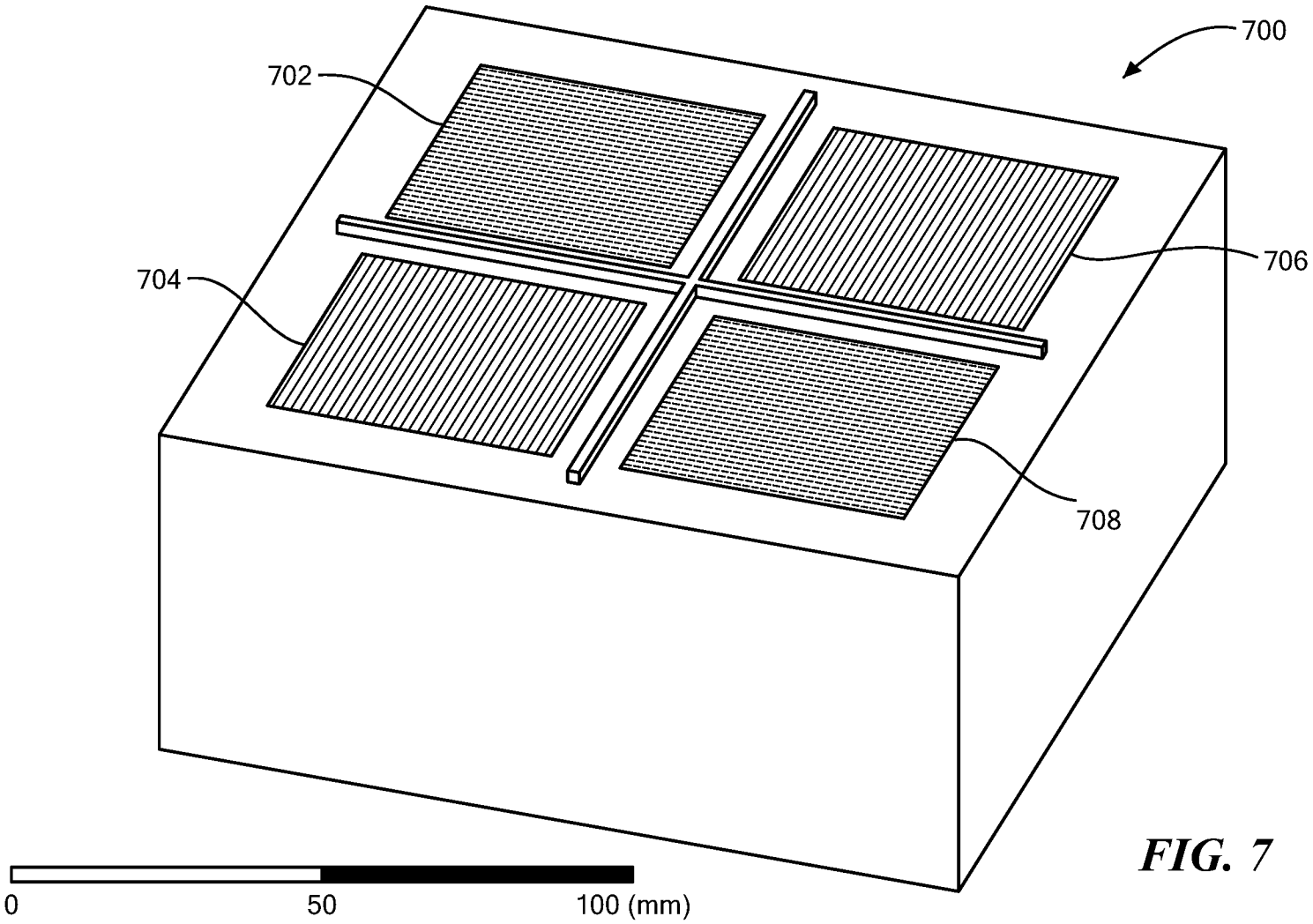
FIG. 7 is a schematic representation of an array having transmit and receive arrays for first and second polarizations implemented with example N×M element subarray blocks in accordance with illustrative embodiments of the disclosure.

FIG. 7 shows an example dual polarization W-band AESA 700 with continuous wave (CW) simultaneous transmit/receive capability. The array 700 includes an H-polarization transmit subarray 702, a V-polarization transmit subarray 704, a V-polarization 706 receive subarray, and an H-polarization receive subarray 708. In embodiments, 32×32 elements subarrays are used.

It is understood that a wide variety of N×M element subarrays, polarization types and configurations, and be selected to meet the needs of a particular application.

Embodiments of the disclosure provide a subarray element architecture that may be compatible with half wavelength element spacing at frequencies high as 100 GHz and even higher. Compact cold plate(s) with micro-channels for forced liquid cooling provide effective heat removal. The cold plates may be fabricated by diffusion bonding or by ultrasonic bonding, for example. Cooling liquid is distributed to 8×1 or 12×1 element subarrays, for example.

Example embodiments of the disclosure are applicable to transmit/receive systems in which relatively high power components are used that require significant heat dissipation capability. Example systems include radar systems, communication networks, such as 5G wireless networks, etc.

Having described exemplary embodiments of the disclosure, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. An apparatus, comprising:

a rectangular N×M antenna element subarray composed of M N×1 element blocks having opposed first and second major surfaces and first and second ends at opposite ends of the element block, wherein the antenna elements are located at the first end of the block;

a high power amplifier chip and/or a high power transmit/receive chip directly behind each of the antenna elements;

a N×1 element beam-former chip directly behind the amplifier chip and/or transmit/receive chip;

a first inlet connector that runs through the block between the first major surface and the second major surface for flow of a liquid coolant;

a first outlet connector that runs through the block between the first major surface and the second major surface for flow of a liquid coolant; and a coldplate with embedded microchannels between the first inlet connector and the first outlet connector to enable flow of the liquid coolant from the first inlet connector to the first outlet connector, wherein the first inlet connector is configured to enable flow of the liquid coolant into the block in a direction that is normal to the first major surface.

2. The apparatus according to claim 1, further including a first seal for the first inlet connector and a second seal for the first outlet connector.

3. The apparatus according to claim 2, wherein the first and second seals are configured to provide respective connections to seals on an adjacent block in an enclosure.

4. The apparatus according to claim 1, further including a second inlet connector and a second outlet connector on the second major surface.

5. The apparatus according to claim 1, wherein M=1.

6. The apparatus according to claim 1, further including an electrical connector on a second end of the block.

7. The apparatus according to claim 1, further including a beamformer integrated circuit on the coldplate.

8. The apparatus according to claim 1, further including a number of utility blocks in the array each configured to receive flow of the liquid coolant and provide the liquid coolant to the stacks of blocks to enable an increase in a size of the array compared to an array without the utility blocks, wherein the utility blocks do not include antenna elements that radiate.

9. The apparatus according to claim 1, wherein the antenna elements of the array are spaced at wavelength $\lambda/2$ for frequencies up to 100 GHz.

10. The apparatus according to claim 1, wherein antenna elements of the array comprise MMICs with on-chip antennas.

11. The apparatus according to claim 1, wherein the array includes more than 10,000 antenna elements.

* * * * *